US009202376B1

(12) United States Patent
Evans

(10) Patent No.: US 9,202,376 B1
(45) Date of Patent: Dec. 1, 2015

(54) PARKING MANAGEMENT SYSTEM RELATED TO STREET CLEANING

(71) Applicant: David Anthony Evans, Bronx, NY (US)

(72) Inventor: David Anthony Evans, Bronx, NY (US)

( * ) Notice: Subject to any disclaimer, the term of this patent is extended or adjusted under 35 U.S.C. 154(b) by 225 days.

(21) Appl. No.: 14/012,727

(22) Filed: Aug. 28, 2013

(51) Int. Cl.
*G08G 1/14* (2006.01)

(52) U.S. Cl.
CPC ..... *G08G 1/149* (2013.01)

(58) Field of Classification Search
CPC ..... G08G 1/14; G08G 1/144; G08G 1/145–1/149
USPC ..... 340/932.2; 705/13
See application file for complete search history.

(56) References Cited

U.S. PATENT DOCUMENTS

| | | | | |
|---|---|---|---|---|
| 6,952,171 | B2 * | 10/2005 | Puccioni | 340/932.2 |
| 7,424,968 | B2 | 9/2008 | Meyerhofer et al. | |
| 7,538,690 | B1 * | 5/2009 | Kaplan et al. | 340/932.2 |
| 7,741,965 | B2 | 6/2010 | Cheung et al. | |
| 7,889,099 | B2 | 2/2011 | Aubrey et al. | |
| 7,936,283 | B2 | 5/2011 | Kim | |
| 7,973,641 | B1 | 7/2011 | Huang | |
| 8,063,797 | B1 | 11/2011 | Landman et al. | |
| RE43,245 | E * | 3/2012 | Ouimet et al. | 705/13 |
| 8,473,807 | B2 | 6/2013 | Kim et al. | |
| 2002/0190645 | A1 | 12/2002 | Moore | |
| 2003/0144690 | A1 | 7/2003 | Dan | |
| 2006/0227010 | A1 * | 10/2006 | Berstis et al. | 340/932.2 |
| 2010/0302068 | A1 * | 12/2010 | Bandukwala | 340/932.2 |
| 2012/0285790 | A1 | 11/2012 | Jones et al. | |
| 2013/0307704 | A1 * | 11/2013 | Morales et al. | 340/932.2 |

* cited by examiner

*Primary Examiner* — Albert Wong
(74) *Attorney, Agent, or Firm* — David Anthony Evans

(57) ABSTRACT

A parking management system and method with regard to street cleaning and parking regulations. A data collection method and system. A system and method to make available multiple parking spots at a time.

11 Claims, 9 Drawing Sheets

PARKING MANAGEMENT SYSTEM RELATED TO STREET CLEANING

CROSS REFERENCE TO RELATED APPLICATIONS

This application claims the benefit of provisional patent application Ser. No. 61/701,949, filed 2012 Sep. 17 by the present inventor.

BACKGROUND—PRIOR ART

1. Background

This application relates to parking management systems and methods, particularly with regard to street cleaning.

The following is a tabulation of some prior art that presently appears relevant:

| U.S. Patents | | | |
|---|---|---|---|
| Pat. No. | Kind Code | Issue Date | Patentee |
| 7,936,283 | B2 | Apr. 27, 2007 | Kim |
| 8,063,797 | B1 | Jul. 31, 2010 | Landman et al. |
| 7,973,641 | B1 | Jun. 7, 2006 | Huang |
| 7,424,968 | B2 | Aug. 27, 2004 | Meyehofer et al. |
| 7,889,099 | B2 | Apr. 4, 2006 | Aubrey et al. |
| 7,741,965 | B2 | May 19, 2005 | Cheung et al. |
| 8,473,807 | B2 | May 10, 2005 | Kim et al. |

| U.S. Patent Application Publication | | | |
|---|---|---|---|
| Publication Nr. | Kind Code | Publ. Date | Applicant |
| 20120285790 | A1 | Nov. 15, 2012 | Jones et al. |
| 20020190845 | A1 | Dec. 19, 2002 | Moore |
| 20030144890 | A1 | Jul. 31, 2003 | Dan |

| Foreign Patent Documents | | | | |
|---|---|---|---|---|
| Foreign Doc. Nr. | Cntry Code | Kind Code | Pub. Dt | App or Patentee |
| 2002063570 | WO | A2 | Jan. 9, 2003 | Howard |
| 2105904 | EP | A1 | Sep. 30, 2009 | Herwich |

2. Prior Art

As urban areas began to grow, it was only natural for various problems relating to traffic patterns and parking management to simultaneously increase in these areas as well. At this time congestion became a major problem and concern for both municipalities and their citizens.

Private companies and municipalities are constantly working on different parking systems and methods to better control traffic flow, payment efficiency, traffic rules, parking regulations, parking regulation enforcement and a number of other elements directly relating to these problems.

Originally citizens were completely dependent upon posted signs for parking regulation rules. They were also dependent on single parking meters collecting coins at individual parking spots. Over time as technology advanced, so too did the parking options for citizens and municipalities.

Prior art discloses technology to offer an alternative to municipalities having a single parking meter designated for every parking space. However, this method is limited to paid parking areas only and does not address public parking that is not in a metered area. Others use technology to help citizens determine what parking restrictions apply to specific areas, however, this information is hard wired just as the signs on the street and provide no flexibility in real time. This is also limited to end users who are not only technologically savvy, but also have access to the physical technology to retrieve the information.

Still others use technology and range sensors to detect parking spaces, which again leaves a problem with regard to the overall flow of traffic as it is focused on a single parking space on a street or within a parking structure. Others use similar technology to alert enforcers as to when a vehicle is entering and parking in a restricted area. These again are focusing on one vehicle at a time.

All of the parking systems and methods heretofore known suffer from a number of disadvantages:

(a) They all relate to a single parking spot within a larger street block or parking structure. This in itself can create several problems for the end user, whether it a citizen looking for parking or an official looking to enforce the rules and regulations. When alerted to an open space or available spot via different technologies, several citizens may rush to get to the same spot. This will be dangerous for pedestrians along the route as well as the other drivers trying to get to the same spot. In addition, the vehicles that are not successfully first to arrive to the spot will then be left in the same situation as they were prior to the alert of the newly opened space. The problem created for officials is that they are still in a position that they need to micromanage the system on a space by space basis. Officials still need to manually oversee every vehicle that they are monitoring and it does little to ease the administrative burden.

(b) When thinking in terms of singular spaces, even within larger methods or systems, there is a problem of excess emissions. Vehicles that are unsuccessful in securing the newly available single spot will be left idling and circling in wait for the next single space to become available.

(c) Street parking in municipalities is also in residential neighborhoods, however, the prior systems and methods focus only on the commercial and business districts that have paid parking spots. The residents of the other areas are left with the hardwired parking regulations and have no solutions made available to increase their quality of life.

(d) The systems and methods previously introduced allow users to check the status and regulations in the English language only. This is a problem for the many residents to whom English is not a first language.

(e) The prior art technologies are dependent upon the end user having a smartphone or having constant access to a smartphone, which is unrealistic for a large segment of the general population.

(f) The prior art technologies are useful exclusively to the technologically savvy citizen that would be able to navigate various web based and mobile applications to get to the end results. These systems discriminate the share of the citizens that are not knowledgeable of these technologies but still have a need for the information.

SUMMARY

In accordance with one embodiment a parking system and method that directly operates with regard to street cleaning rules and regulations.

Advantages

Accordingly several advantages of one or more aspects are as follows: to provide a parking system and method that will make available several parking spaces at a time, that will reduce excess emission into the environment, that will be multi-lingual, that will be available to people of various technological skill and know-how, that will include coverage of residential as well as commercial areas. Other advantages of one or more aspects will be apparent from a consideration of the drawings and ensuing description.

DRAWINGS

Figures

In the drawings, closely related figures have the same number but different alphabetic suffixes.

DRAWING - REFERENCE NUMERALS

| | | | |
|---|---|---|---|
| 120 | central processing unit | 122 A-D | signal device |
| 124 | vehicle device | 126 | active GPS device |
| 128 | RFID transponder | 130 | override button |
| 132 | system owner | 134 | citizen system website |
| 136 | citizen system mobile application | 138 | citizen in-car navigation |
| 300 | citizen user | 400 | regulation sign |
| 500 A-J | street | 600 | street cleaner |

DETAILED DESCRIPTION

Figure 1:
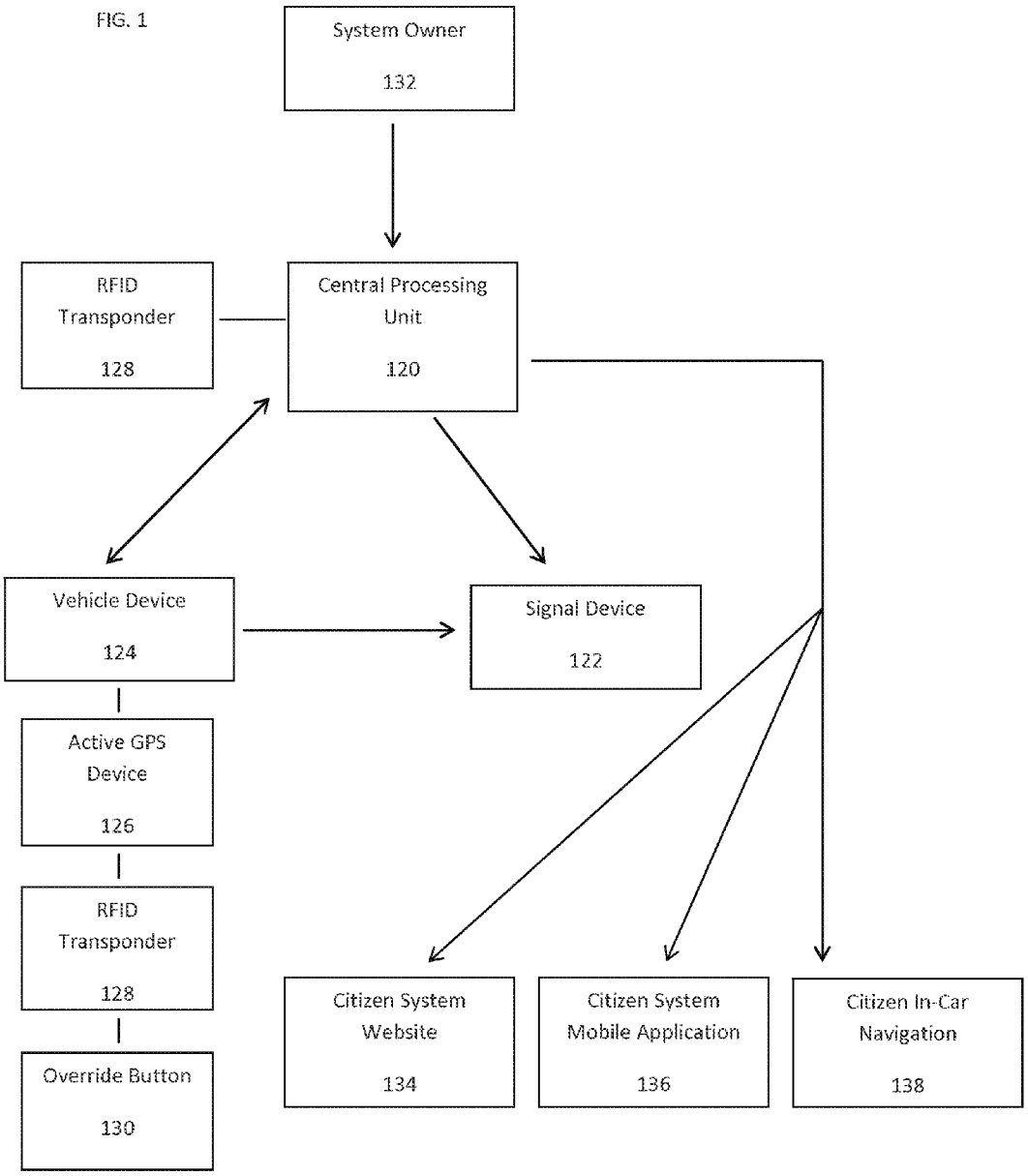
FIG. 1 illustrates a flowchart of the hardware communication process.

FIG. 1—First Embodiment

One embodiment of the system is illustrated in FIG. 1.

The central processing unit 120 will act and operate as the central piece between all communications throughout the system. The central processing unit 120 will both send and receive information. The central processing unit 120 will contain a radio frequency identification transponder 128, herein referred to as a RFID transponder.

A plurality of vehicle devices 124, each with its own unique identification, which will be herein be referred to as the vehicle ID, will send and receive information. A vehicle device 124 will be contained within a plurality of street cleaners 600, one for each street cleaner 600. The vehicle device 124 will contain an active GPS device 126 as well as an onboard RFID transponder 128.

A plurality of signal devices 122 will be positioned along a plurality of streets 500 in a distance that is visible from a corresponding regulation sign 400 along each street 500. Each signal device 122 will have its own unique identification, which will herein be referred to as the signal ID. Each signal ID will also be referred to interchangeably as its geotag. Each signal device 122 will receive information.

Information received by the central processing unit 120 from the vehicle device 124 will then be sent from the central processing unit 120 to the citizen system website 134, the citizen system mobile application 136, and the citizen in-car navigation 138, all in real-time.

Operation—FIGS. 1-9

The central processing unit 120 will store information directly pertaining to each system owner's 132 municipality or coverage area. This information will include but not be limited to, all street names and mapping information as well as all street cleaning rules and regulation information for the corresponding streets 500.

Figure 4:
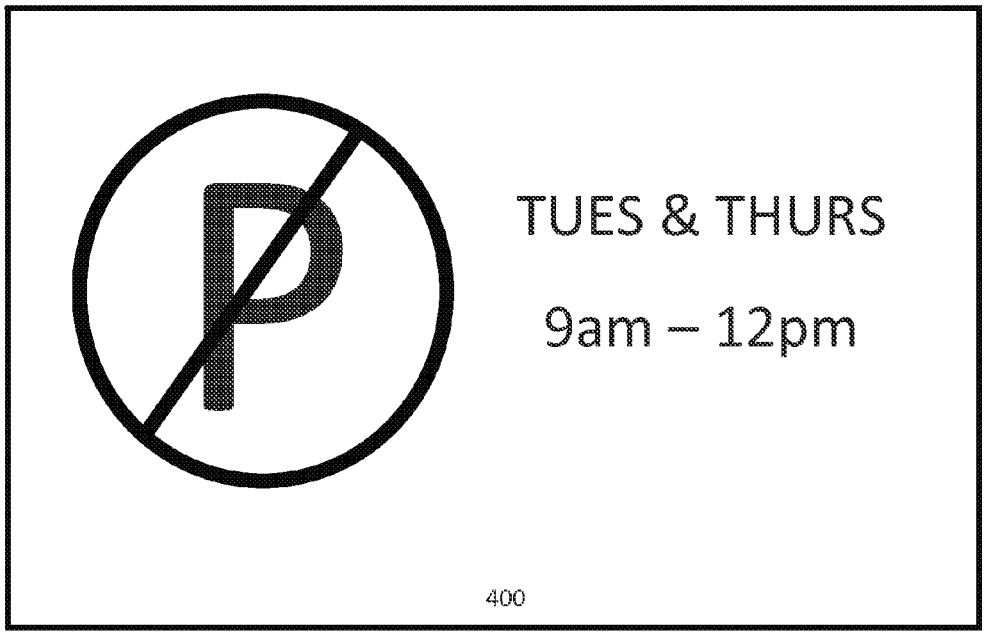
FIG. 4 shows an example of a regulation sign.
Figure 5:
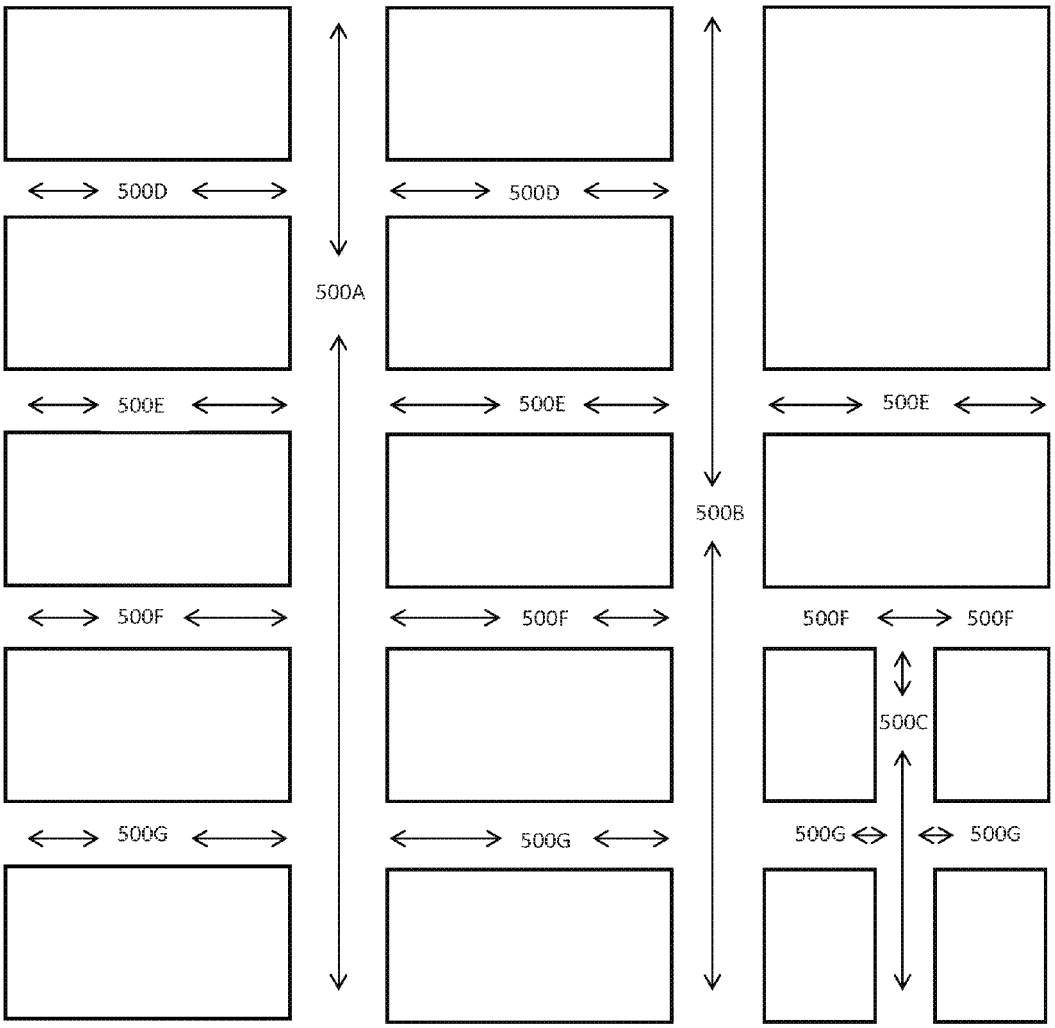
FIG. 5 illustrates an overhead view of several city streets from a distance.
Figure 6:
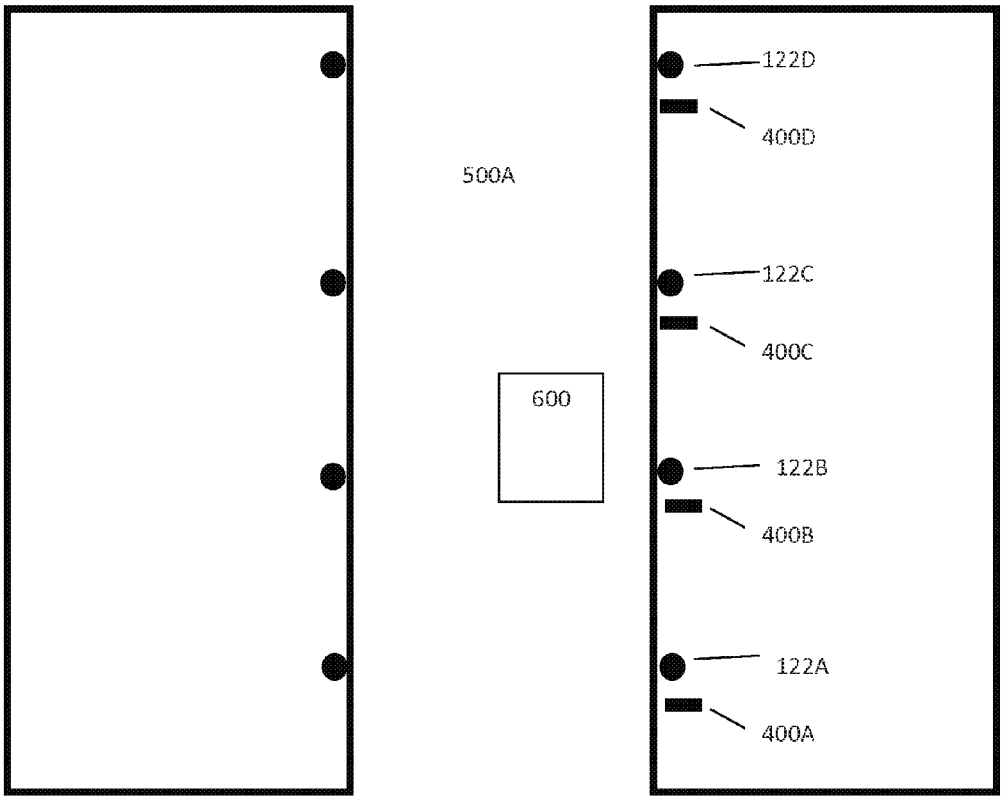
FIG. 6 illustrates a zoomed-in overhead view of a street layout.

Along each street 500 within a municipality or area, there is a plurality of regulation signs 400 posted along said streets 500 to notify citizens as to the street cleaning rules for that specific block. An example of a regulation sign 400 is illustrated in FIG. 4.

Figure 2:
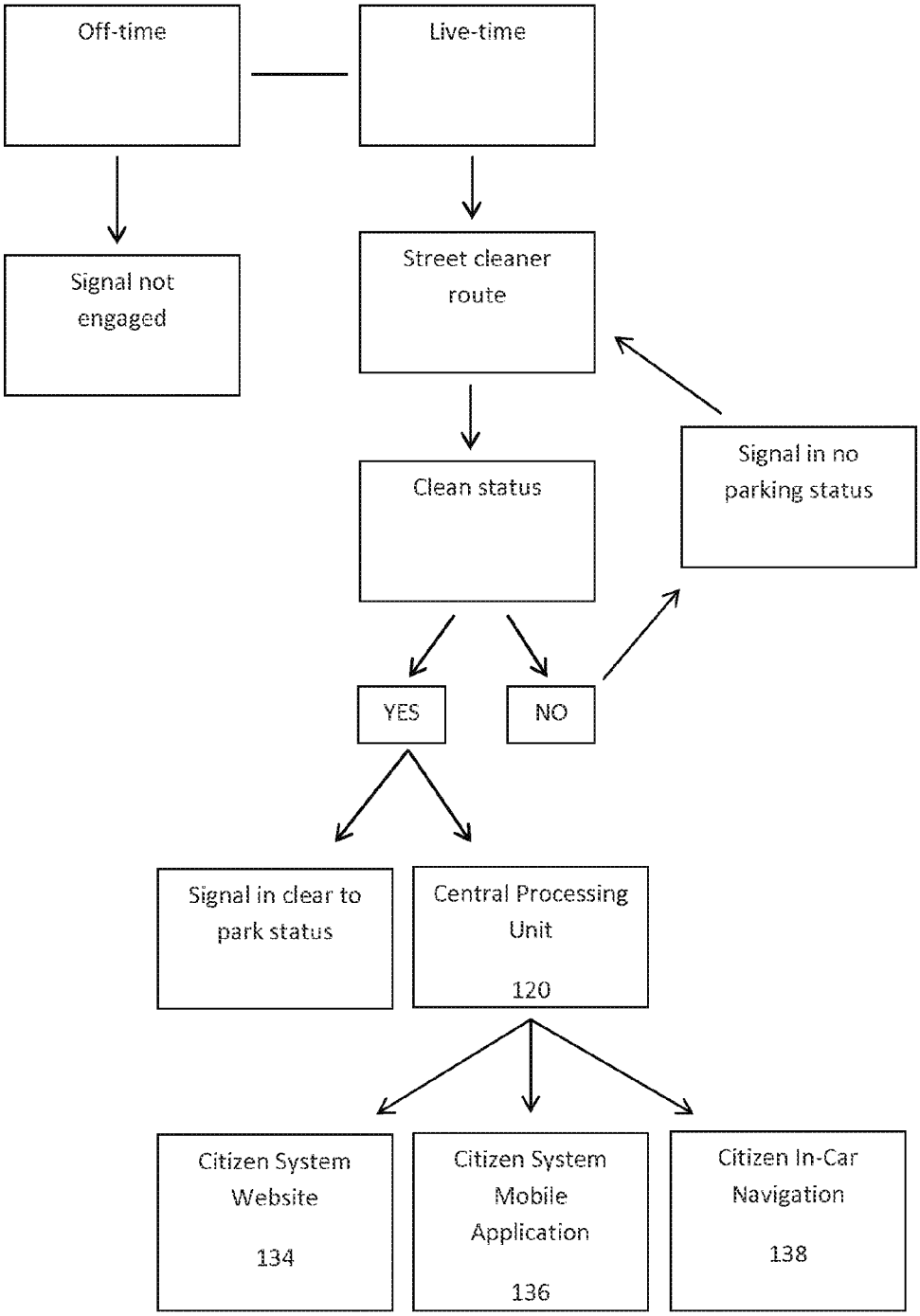
FIG. 2 illustrates a flowchart of the engagement process.

At this point the engagement process illustrated in FIG. 2 begins. When the current day and time falls outside of the posted day and time on a specific regulation sign 400, the corresponding signal device 122 is not engaged. In these instances citizens are normally allowed to park in the designated areas as there are no street cleaning regulations currently in force. When the current day and time falls within the posted day and time on a specific regulation sign 400, the signal device 122 will be sent information by the central processing unit 120 to trigger and now begin the engagement period, this is also herein referred to as live-time. As soon as the engagement period, or live-time begins, the signal device 122 will be changed to a no parking status to alert citizens that it is not yet clear to park and the no parking rules relating to the street cleaning are in full effect. One way in which the signal device 122 can illustrate that the parking status is in a no parking state would be to project a colored light, possibly red or another color. However, there are several other methods that may be used to alert citizens that the current parking status is in the no parking status. In instances in which a street cleaner 600 may arrive at a street 500 along its route prior to when regulation sign 400 would otherwise go into effect, the system owner will have options to adjust any trigger timing from the central processing unit 120 to the signal device 122 to begin the live-time prior to the start time posted on the regulation sign 400. For example, a system owner 120 may elect for the live-time period to begin one hour before the posted time on a given regulation sign 400 or any other time frame that they may desire. To avoid confusion for the citizen user 300, the signal device 122 may engage and project a different result from whatever method that is used to show that the current status is no parking. One method to show this could be to project a color, such as yellow to display that the live-time is soon to begin, but the parking regulations are not yet enforced, however a number of other methods can be used to illustrate this as well. One way in which the signal device 122 can illustrate that the engagement period has begun will be to project a colored light, possibly in red or another color. However, there are several other methods that may be used to alert citizens that the live-time period has begun and it is not yet clear to park.

During the live-time period the street cleaner 600 will be driving along a predetermined designated route. The routes will be predetermined and will coincide with the regulations to specific streets 500. These routes will bring the street cleaner 600 along designated sides of the streets 500 that will match with the days and times posted on the regulation signs 400 along the route.

As the street cleaner 600 proceeds along the route, each driver will have the option to engage an override button 130 within the vehicle device 124. The override button 130 option will be used in circumstances that the street cleaner 600 will need to make multiple passes to accomplish satisfactory cleaning of the current street 500. Some of these events to make an override necessary may include excessive garbage on the streets, construction, or a number of other circumstances, making more than one pass necessary to effectively complete the street cleaning process. When the override button 130 is engaged, it will not affect any other data communication or process within the system. When engaged, the vehicle device 124 will not communicate to the signal device 122 that it should change to a clear to park status.

Upon the second pass along a given street 500, in which the first pass the driver had engaged the override button 130, if the driver now feels that the job will be accomplished they will disengage the override button 130 and proceed in normal course.

Figure 7:
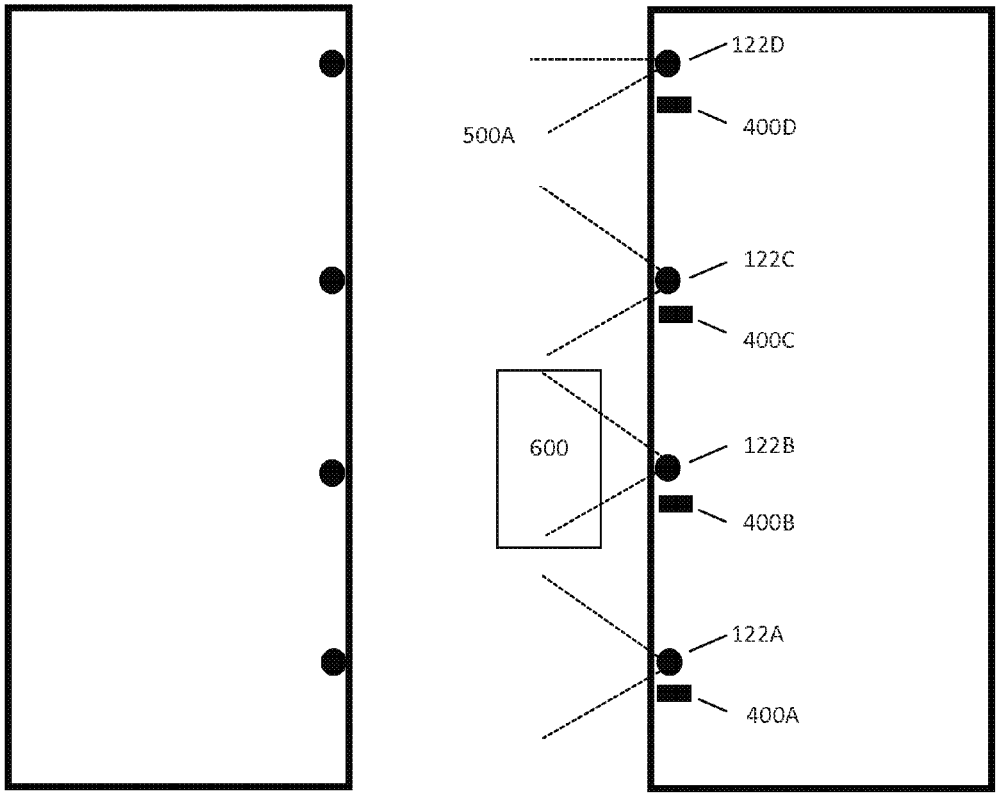
FIG. 7 illustrates an overhead view of a signal device area and a street layout.

At this point in the street cleaning process that the street cleaner 600 will pass through each frequency zone directly relating to each specific signal device 122 as illustrated in FIG. 7. The vehicle device 124 will communicate to the signal device 122 to now change the status from no parking to a clear to park status. One way in which the signal device 122 can illustrate that the status has changed from no parking to a clear to park will be to project a colored light, possibly in green or another color. However, there are several other methods that may be used to alert citizens that the parking status has now changed from no parking to parking.

Simultaneously as the vehicle device 124 is sending information to the signal device 122 to update the status, it will also be sending the same information to the central processing unit 120. The central processing unit 120 will receive the information and immediately send it on to the citizen system website 134, the citizen system mobile application 136, and the citizen in-car navigation 138 which will all update in real-time, reflecting such information to the citizen user 300.

When the engagement period has come to an end and the current day and time no longer fall within the regulation times posted on a given regulation sign 400, the signal device 122 will then return to a non-engaged state. Though the system owner 132 may elect to leave the regulation sign 400 engaged for as long as they want.

Figure 3:
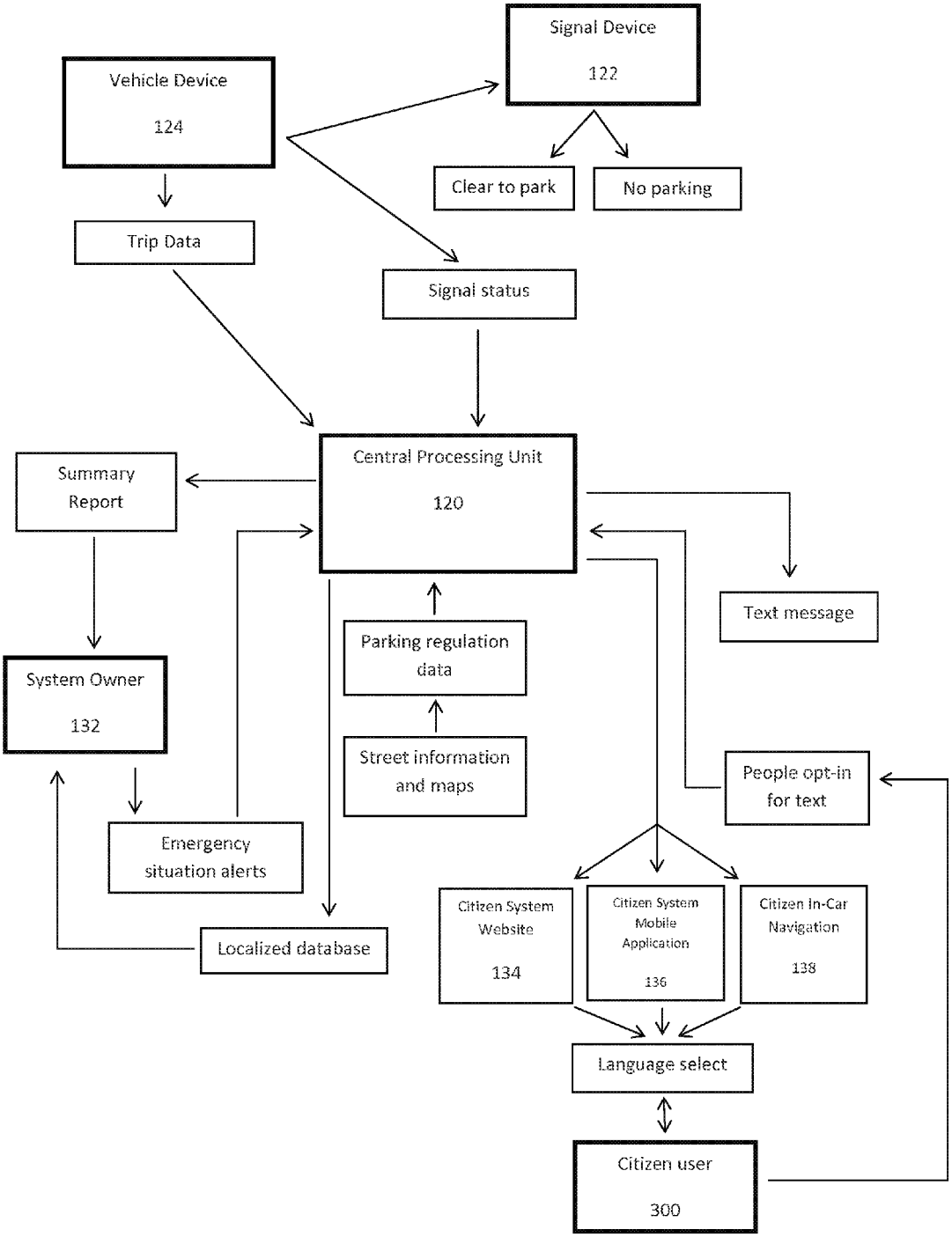
FIG. 3 illustrates a flowchart of the data communication process.

The communication through the hardware will take place throughout both the live-time process and the non-engaged periods. Some of the information communicated during this process is illustrated in FIG. 3.

The system owner will be in control of everything related to the process and methods for their specific territory.

The central processing unit 120 is stored with street 500 information covering the entirety of area within the system owner's 132 possession, or as chosen by the system owner 132. In addition to the street 500 information the central processing unit 120 is also stored with maps reflecting such information. The central processing unit 120 is additionally stored with the corresponding parking rules and regulation for each individual street 500 within the area. The central processing unit 120 may also be stored with other parking rules and regulations not directly linked to street cleaning as well as any other information that the system owner 132 shall feel necessary to include into the central processing unit 120. This information will include but not be limited to the day, start time, end time and side of the street in which the street cleaning rules will apply.

The street cleaner 600 will use its signal device 122 to collect data directly related to each street cleaner 600 specific route. Each time a street cleaner 600 goes out to begin a route, the route will be assigned a trip identification number or code, which will herein be referred to as the trip ID. There will also be unique identification assigned to each vehicle device 124 and signal device 122. When the street cleaner 600 passes the signal device 122 the vehicle device 124 will send this information back to the central processing unit 120, which will compile and store all of this information. The route will then collect various information directly related to the route, including but not limited to date and time in which the vehicle device 124 passes each signal device 122, and the total timing of the route as a whole. This information will allow for detailed breakdowns regarding each and every trip. This will allow the system owner 132 the opportunity to run weekly, monthly, yearly, or any other desired time frame averages on routes and drivers to maximize the cleaning efforts and efficiencies. The system will be able to collect and store various other information desired by the system owner 132 as well.

The data transmission to the signal device 122 can potentially be received both via cellular antenna (primary) and a radio frequency identification transponder 128, herein referred to as a RFID transponder 128, or also by other means. The signal device 122 will receive on-and-off data primarily from the central processing unit 120 potentially via the cellular antenna as it will also receive on-and-off data locally via the RFID transponder 128 once the street cleaner 600 passes within range and is set to transmit, but can possibly receive information through other means as well. The signal device 122 will be set with a pre-determined frequency range to make sure that as a street cleaner 600 makes a pass on one street that it will not signal the geo-tag of a signal device 122 on an adjacent street 500. This would eliminate the potential of a false positive being sent to an unfinished street 500. The trip data will be communicated from the vehicle device 124 to the central processing unit 120 regardless of the status of the override button 130. The vehicle device 124 will also be equipped with an active GPS device 126 that will relay the street cleaner 600 coordinates to the central processing unit 120 in real time. The street cleaner 600 location will then be transmitted from the central processing unit 120 to the citizen system website 134, citizen system mobile application 136, and citizen in-car navigation 138 so that the citizen user 300 can track the progress of the street cleaner 600 along its specified route. The active GPS device 126 can be a customized active GPS transmitter that is outfitted with an onboard RFID transponder 128. The active GPS device 126 can be equipped with a cellular antenna that allows the device to send and receive data between the central processing unit 120 and the vehicle device 124. The onboard RFID transponder 128, which is housed within the active GPS device 126, can be used to communicate to the signal device 122 to trigger the signal device 122 of a status change that the citizens will view. The vehicle device 124 will be affixed somewhere within every street cleaner 600 that will be on the streets 500 driving along designated cleaning routes. The vehicle device 124 could be hard wired in the street cleaner 600, connected to the main battery via a link to ignition, only powered when ignition is in the on position, which will be mounted under the dashboard, or could be set up and powered a number of other ways as well. The data transmission through the vehicle device 124 can be wireless, both via cellular and radio-frequency technologies, but a number of other options could work as well.

The central processing unit 120 can communicate to the signal device 122 by sending data transmission using cellular towers, or any other means. The information transmitted throughout this process will include street cleaning schedules of specific dates and times from the central processing unit 120 to the signal device 122. The signal device 122 will activate or engage accordingly with respect to received data. This information will include the current time when the designated area around the signal device 122 is now within the designated date and time that the no parking rules apply for the street cleaning purposes, frequently referred herein as live-time. At the beginning of live-time, the signal device 122 will become engaged. Typically at the beginning of live-time the signal device 122 will be engaged in a no parking state. One way in which this can be accomplished will be by projecting a red light to the citizens, however, a number of other ways to alert the citizen are also possible. The signal device will be engaged throughout the entirety of the live-time window, and possibly both during a time prior to the live-time as well as after the live-time window.

The system owner will have access to all the data that the central processing unit 120 has collected from each trip and can manipulate it into various summary reports as needed.

As the street cleaner 600 drives along its assigned route, the vehicle device 124 will be sending information to both the signal device 122 and the central processing unit 120. As the street cleaner 600 passes each signal device 122 it will communicate to the signal device 122 that it is to now change from a no parking status to a clear to park status. At the same time that the vehicle device 124 communicates this information to the signal device 122 it also communicates the same information to the central processing unit 120. The central processing unit 120 will collect this information as well as the geo-tag information from the vehicle device 124 as another way in addition to the GPS to track the street cleaners 600 progress along its designated route. As soon as this information is received by the central processing unit 120 it is in turn sent from the central processing unit 120 to the citizen system website 134, the citizen mobile application 136, and the citizen in-car platform 138. When the driver has engaged the override button 130, the vehicle device 124 will not communicate any change of status information to the signal device 122. All other communication will continue as normal.

A citizen user 300 of the parking system and method will be the end user of the citizen system website 134, citizen system mobile application 136, and citizen in-car navigation 138.

Figure 8:
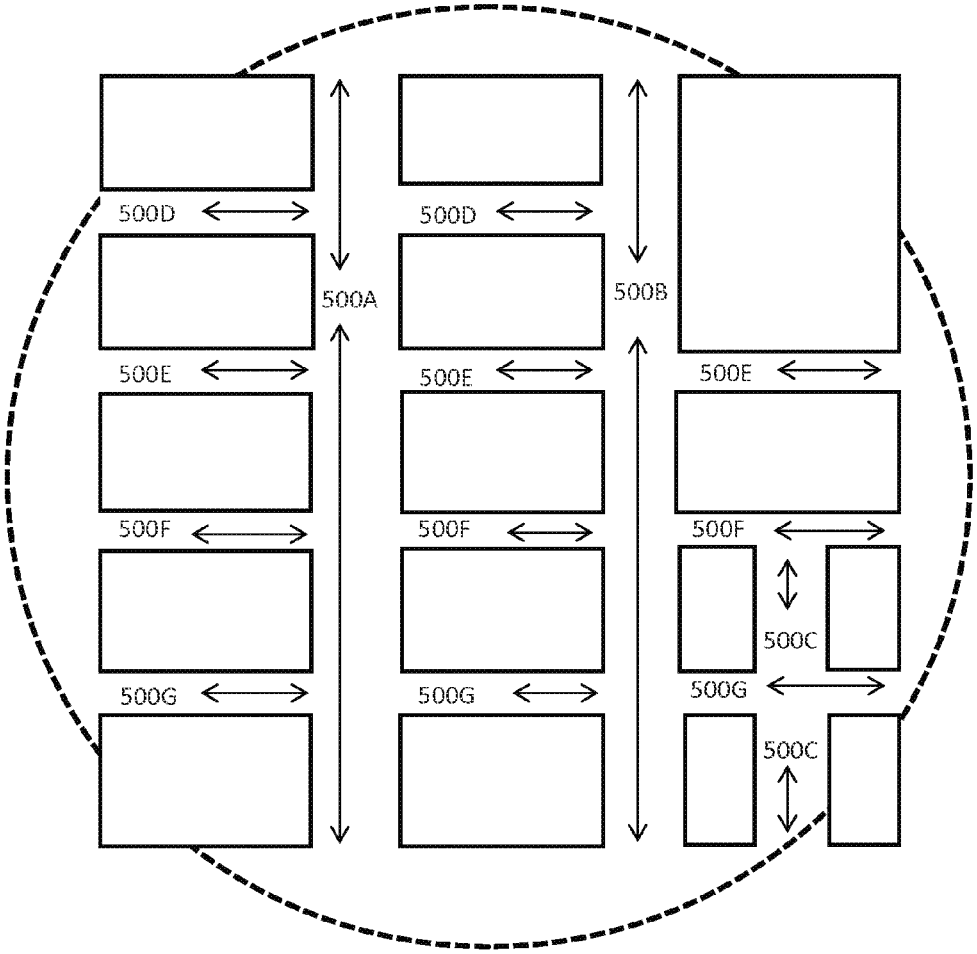
FIG. 8 illustrates how the citizen user would select the first number set of the opt-in text program.
Figure 9:
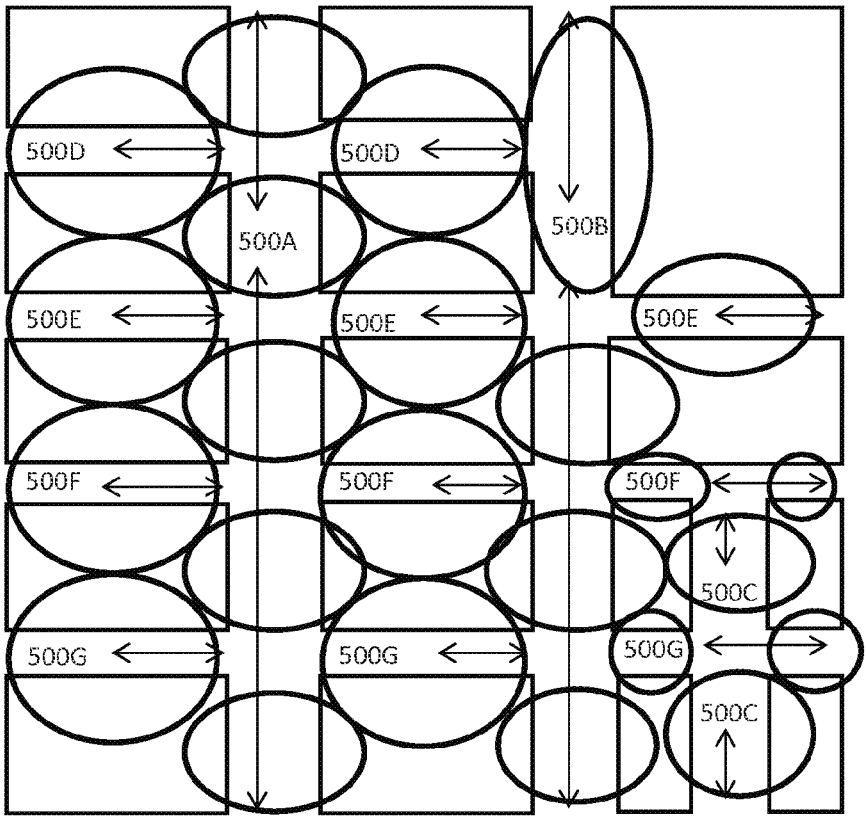
FIG. 9 illustrates how the citizen user would select the second number set of the opt-in text program.

When the citizen user 300 uses the various resources of the citizen system website 134, citizen system mobile application 136, or the citizen in-car navigation 138, they will be given the choice to select which language they would like to view the various options in. The citizen user 300 will also have the option to add their mobile phone number into the database through one of these resources. At the time of entering their number they will also have to choose an area location. They will choose from a predetermined area in accordance with each individual street cleaner 600 route. This will allow the central processing unit 120 to code the citizen mobile phone number into a general neighborhood area. This is illustrated in FIG. 8. The citizen user 300 will then need to select a further predetermined number set that has a unique number for each street 500 and furthermore, for each specific block. This is illustrated in FIG. 9. The citizen system website 134, citizen system mobile application 136, and citizen in-car navigation 138, will have a number of ways for the citizen user 300 to determine which number set applies to them specifically. One of these options will be to select from a map in which they can click on their selected block. Upon choosing both corresponding number sets to the citizen user 300 area, they will then send this information to the central processing unit 120. The central processing unit 120 will store this information and begin to build a local database for the system owner 132, storing each number with its corresponding geographical location.

When the citizen user 300 has completed the area selections and optioned into the text program through the citizen system website 134, citizen system mobile application 136, or citizen in-car navigation 138, from that point forward the central processing unit 120 will automatically send an alert text message to the citizen user 300 when the vehicle device 124 has sent information to the central processing unit 120 that the regulation signal 400 has changed along the route of the citizen user's 300 selected area. This will alert the citizen user 300 in real-time as to the now available parking on their selected street 500.

In addition to building a localized database through the central processing unit 120 and the citizen user 300 option in text program, the system owner 132 will also have a localized text messaging list in cases of emergency. These emergencies can include but not be limited to water main breaks, down trees, down power lines, or car accidents. In these instances, the system owner 132 will be better equipped to alert citizen users 300 of the affected area more quickly and direct. The localized text messaging list can also prove useful in planned or predetermined interruptions of normal regulation rules. These can include but are not limited to street festivals, construction, or filming. In the scenario of a planned and predetermined interruption of normal regulation rules, the system owner 132 may also opt for the central processing unit 120 to engage the signal device 122 to a no parking status.

Advantages

From the description above, a number of advantages of some embodiments of my parking management system and parking management method become evident:

(a) Parking regulations with regard to street cleaning will now be in a fluid and flexible state rather than static with hard set start and end times.

(b) Instead of opening only one parking spot at a time, entire blocks of parking will be opened simultaneously.

(c) With opening up entire blocks of parking at a time, the system will lower the emissions released into the environment by eliminating the need for constant circling or idling.

(d) Allowing non-technologically advanced citizens, and those citizens without the physical technologies to use, to enjoy the benefits of the system and method.

(e) Data bases will be built across a number of different areas that will prove useful to the system owner.

(f) One such data base that will be built from the system and method from opt-in users will be localized to different residential areas that will prove valuable in the event of emergencies or other events that require information to be disseminated to residents that will be outside of the normal regulations (i.e—no parking on certain days due to road work, festivals, etc. that would otherwise be unforeseen and in the past limited to alerting residents by only hanging temporary signs along the street).

(g) The information stored in the data base will also now provide a platform to cross check contested parking tickets to give a time in which the parking restriction ended as compared to the time printed on the ticket.

Conclusion, Ramifications, and Scope

Thus the reader will see that at least one embodiment of the parking management system provides a more efficient, user friendly, yet informational method that can be used by all drivers.

While my above description contains many specificities, these should not be construed as limitations on the scope, but rather as an exemplification of one [or several] embodiment(s) thereof. Many other variations are possible. For example, regulation signs can alert citizen users to a change in status by signs that have projected writing as to the current status.

Accordingly, the scope should be determined not by the embodiment(s) illustrated, but by the appended claims and their legal equivalents.

I claim:

1. A system for altering and notifying users of changes in parking restrictions comprising:

one or more signs indicating parking restrictions on a street;

a changeable visual indicator located near each sign to indicate the status of the posted parking restrictions; and a street cleaning vehicle in communication with the changeable visual indicators and a remote central processing unit wherein when the vehicle passes by each changeable visual indicator the street cleaning vehicle sends a signal to the visual indicators to change the status of the indicator to permit parking on the street and sends a second signal to the remote central processing unit to update a database in the central processing unit that determines the current parking restrictions on the streets.

2. A system for altering parking restrictions as recited in claim 1 further comprising the central processing unit, wherein the central processing unit notifies drivers of areas with permissible parking.

3. A system for altering parking restrictions as recited in claim 2 wherein the central processing unit automatically notifies drivers of a change in status.

4. A system for altering parking restriction as recited in claim 1 further comprising the central processing unit, wherein the central processing unit is in communications with the changeable visual indicators and is able to remotely change the parking restrictions.

5. A system for altering parking restrictions as recited in claim 3, further comprising the central processing unit, wherein the central processing unit is also able to notify drivers of the reasons for changing a parking status.

6. A system for altering parking restrictions as recited in claim 1, wherein the street cleaning vehicle operator can inhibit communications by the vehicle and maintain the parking restriction when moving past the visual indicator.

7. A method for changing the parking status of a street and notifying users of the status comprising:

placing at least one sign with parking restrictions on a street;

placing a changeable visual indicator near each sign to indicate if the parking restrictions are currently valid; and moving a street cleaning vehicle along the street and sending a signal to change the status of each sign as the vehicle passes by each sign and sending a second signal to a remote processing unit with a database to keep track of the changed status of each sign and street.

8. A method for changing the parking status of a street as recited in claim 7, further comprising the step of making the database information available to drivers in real time.

9. A method for changing the parking status of a street as recited in claim 8, wherein the database information is automatically sent to driver devices to assist the driver in locating an available parking space.

10. A method for changing the parking status of a street as recited in claim 8, wherein the information includes reasons for the current parking status.

11. A method for changing the parking status of a street as recited in claim 7, wherein the street cleaning vehicle operator can inhibit communications by the vehicle and maintain the parking restriction when moving past the visual indicator.

* * * * *